United States Patent [19]

Sato et al.

[11] Patent Number: 5,003,516

[45] Date of Patent: Mar. 26, 1991

[54] ULTRASONIC PROBE AND MANUFACTURE METHOD FOR SAME

[75] Inventors: Kazuo Sato, Tokyo; Hiroshi Kanda, Tokorozawa; Shigeo Kato, Mitaka; Kuninori Imai, Kanagawa; Takeji Shiokawa, Fuchu; Shinji Tanaka, Akishima; Isao Ishikawa, Hino; Harumasa Onozato, Oume; Hisayoshi Hashimoto, Ushiku; Morio Tamura, Tsuchiura; Kazuyoshi Hatano, Ibaraki; Fujio Sato, Tsukuba; Ken Ichiryuu, Ibaraki; Kiyoshi Tanaka, Mizukaido; Takao Kawanuma, Ibaraki, all of Japan

[73] Assignees: Hitachi Construction Machinery Co., Ltd.; Hitachi, Ltd., both of Tokyo, Japan

[21] Appl. No.: 336,685

[22] Filed: Apr. 12, 1989

[30] Foreign Application Priority Data

Apr. 13, 1988 [JP] Japan ..... 63-89059
Nov. 16, 1988 [JP] Japan ..... 63-287720

[51] Int. Cl.[5] ..... H04R 17/00

[52] U.S. Cl. ..... 367/150; 310/335; 310/336; 29/25.35; 128/662.03

[58] Field of Search ..... 367/150; 310/335, 336; 73/642; 29/25.35, 594; 128/662.03

[56] References Cited

FOREIGN PATENT DOCUMENTS 0032739 1/1981 European Pat. Off. .
56-103327 8/1981 Japan .
58-4197 1/1983 Japan .
59-93495 5/1984 Japan .

OTHER PUBLICATIONS

IEEE 1986 Ultrasonics Symposium, Nov. 1986, vol. 2, pp. 745-748, "Planar-Structure Focusing Lens for Operation at 200 MHz and Its Application to the Reflection-Mode Acoustic Microscope", K. Yamada et al.

Applied Physics Letters, vol. 52, No. 10, Mar. 1988, pp. 836-837, "Chemically Etched Micromirrors in Silicon", D. L. Kendall et al.

RCA Review, vol. 31, No. 2, Jun. 1970, pp. 271-275, "The Etching of Deep Vertical-Walled Patterns in Silicon", A. I. Stoller.

IBM Technical Disclosure Bulletin, vol. 14, No. 2, Jul. 1971, p. 417, "Fabricating Shaped Grid and Aperture Holes", R. A. Leone et al.

Extended Abstracts/Electrochemical Society, vol. 87-2, Oct., 1987, p. 769, "Anisotropic Etching of Silicon for 3-D Microstructure Fabrication".

Electronics Letters, vol. 17, No. 15, Jul. 1981, pp. 520-522, "Linearly Focused Acoustic Beams for Acoustic Microscopy", J. Kushibiki et al.

*Primary Examiner*—Charles T. Jordan
*Assistant Examiner*—J. Woodrow Eldred
*Attorney, Agent, or Firm*—Fay, Sharpe, Beall, Fagan, Minnich & McKee

[57] ABSTRACT

An ultrasonic probe comprising an acoustic lens (20) having a concave lens surface (21) formed on one side of a lens body, and a piezoelectric transducer (23) disposed on the other side of the acoustic lens, ultrasonic waves generated by applying voltage to the piezoelectric transducer being focused through the lens surface to detect the reflected waves of the ultrasonic waves from a sample (26) by the piezoelectric transducer for obtaining information about the surface or interior of the sample. The lens surface (21) of the acoustic lens (20) is defined by an etch profile (15) formed by etching a substrate material (11) which makes up the lens body.

45 Claims, 14 Drawing Sheets

ULTRASONIC PROBE AND MANUFACTURE METHOD FOR SAME

BACKGROUND OF THE INVENTION

The present invention relates to an ultrasonic probe and a manufacture method for same, and more particularly to an ultrasonic probe suitable for use in an apparatus which utilizes high-frequency sound energy, such as an ultrasonic microscope, and a manufacture method for the probe.

In view of the fact that ultrasonic waves with their frequency as high as 1 GHz have wavelengths in the order of about 1 μm in water, ultrasonic microscopes have been fabricated by utilizing signals caused by disturbances such as reflection, scattering, and attenuated transmission. A ultrasonic probe equipped with an acoustic lens is employed as means for condensing an ultrasonic beam onto the objective to be measured. The ultrasonic lens comprises a crystal such as sapphire, quartz glass, or the like, and is configured to have a spherical lens surface on one side and a flat surface on the other side. On the flat surface side, there is disposed a piezoelectric transducer for radiating RF ultrasonic waves in the form of plane waves. The plane waves radiated from the piezoelectric transducer propagate through a lens body, and are then condensed to a certain focus by a positive lens surface that is constituted by the interface between the spherical lens surface and a medium (e.g., water).

To prevent attenuation of the ultrasonic waves while propagating from the lens surface to the focus through the medium, the distance from the lens surface to the focus should be as short as possible. On the other hand, it is required for increasing resolution that the F-number of lens (i.e., the ratio of focus distance to aperture of the lens surface) be sufficiently small. Therefore, the lens surface must be a minute spherical surface with diameter in order of 200 μm. In addition, the lens surface must be free of any unevenness of size larger than 1/10 the ultrasonic wavelength. This size is in order of 0.1 μm when using the ultrasonic waves of 1 GHz.

To date, such an acoustic lens has exclusively been machined by a mechanical grinding technique. From a practical point of view, however, the spherical surface with diameter less than 500 μm could hardly be formed by the mechanical grinding technique. In order to overcome that difficulty, there has been proposed a method of soldifying the surroundings of air bubbles produced in molten glass, and then machining the half surrounding surface of a desired air bubble (JP. A. 58-4197), or a method of pressing a spherical glass ball against a glassy carbon material before sintering, to thereby form a recessed surface, and then sintering the carbon material (JP. A. 59-93495).

However, the method of exploiting air bubbles in the glass has a difficulty in finding out the desired air bubble of proper size. Even if the desired air bubble is found out, it could not be used in practice if any other air bubbles are present in the vicinity thereof. Thus, the proposed method is not likely to become established as a lens manufacture method for industrial purpose. Also, it will be appreciated that this type method cannot provide a lens surface (e.g., cylindrical surface) of the shape other than spherical.

Meanwhile, the method of pressing a glass ball against a glassy carbon material and then sintering the latter has several problems that non-negligible scattering of ultrasonic waves are caused due to the presence of air bubbles or inclusion remaining in the sintered material, and sintering causes a substantial change in size.

Further, the outer edge of the lens surface is usually ground into a tapered shape to keep the unnecessary reflected waves from being received. Observing the ground portion in large magnification, the flat surface is left between the lens surface and the tapered surface. If the tapered surface is machined to an extent that eliminates the flat surface completely, the edge of the lens surface would be chipped off or made somewhat round. In either case, therefore, the noise received through the outer peripheral portion cannot be reduced.

In addition, it becomes feasible to capture a two-dimensional image of the objective to be measured, by densely arranging a number of spherical lenses on a flat surface (JP. A. 56-103327). Also, sound image information could be obtained from multiple points simultaneously if a plurality of lens surfaces can be arrayed on a flat surface with high precision. With the mechanical grinding method and the method of fining out air bubbles in glass, however, it is practically impossible to array a plurality of lens surfaces on a single substrate with high precision. The sintering method cannot avoid some fluctuations in the pitch of lens array concomitant with the sintering step. Moreover, extreme difficulties are encountered in creating an array of lens surfaces by combining many individual single lenses, taking into account the minute lens size.

As described above, the prior art has accompanied the problems of extreme difficulties in machining the lens surface of minute curvature with high precision, and of very expensive acoustic lenses. Another problem was a limitation encountered in reducing the noise received through the outer peripheral portion of the lens surface. Still another problem was in that infeasibility or extreme difficulties were found in obtaining a two-dimensional information of the objective to be measured or obtaining sound image information from multiple points simultaneously by arraying a plurality of lenses on a flat surface with high density and/or high precision.

It is an object of the present invention to provide an ultrasonic probe equipped with an acoustic lens which has a lens surface of the very small radius of curvature and can be fabricated inexpensively, and a manufacture method for the ultrasonic probe.

Another object of the present invention is to provide an ultrasonic probe equipped with an acoustic lens which can reduce the noise received through the outer peripheral portion of the lens surface, and a manufacture method for the ultrasonic probe.

Still another object of the present invention is to provide an ultrasonic probe equipped with an acoustic lens which comprises a plurality of minute lenses arrayed with high density and/or high precision, and a manufacture method for the ultrasonic probe.

SUMMARY OF THE INVENTION

According to the present invention, the above objects are achieved by an ultrasonic probe wherein a lens surface of an acoustic lens is defined by an etch profile formed by etching a substrate material which makes up a lens body.

In one aspect of the present invention, the etch profile of the lens surface includes a spherical etch profile formed by carrying out isotropic etching as said etching.

In another aspect of the present invention, the etch profile of the lens surface includes an etch profile formed by carrying out etching by the use of a mask layer which has a non-circular opening, as said etching.

In still another aspect of the present invention, the etch profile of the lens surface includes an etch profile formed by carrying out etching that has different etch rates dependent on the directions of crystal axes of the substrate material, the etch profile comprising a central portion which has a spherical surface, and a peripheral portion which has a non-spherical surface having the smaller curvature in at least partial region thereof in the depthwise direction than that of the central spherical surface.

In a further aspect of the present invention, the acoustic lens has a plurality of lens surfaces arrayed on the lens body, the plurality of lens surfaces being defined by respective etch profiles formed by carrying out any one sort of said etching.

In still further aspect of the present invention, an acoustic lens further includes a curved surface defined by an etch profile that is formed by etching again the outer peripheral portion of the lens surface with the lens surface covered with a mask layer.

In yet another aspect of the present invention, an acoustic matching layer comprising a thin film formed of a material different from that of the lens body is disposed on at least the lens surface of the lens body.

According to the present invention, the above objects are also achieved by a manufacture method of a ultrasonic probe wherein a mask layer having at least one opening and resistant against etching is formed on the surface of a substrate material which makes up a lens body, and the substrate material is subjected to etching through the opening of the mask layer to provide an etch profile, at least a portion of the etch profile being used as the lens surface.

In one aspect of the present invention, the opening formed in the mask layer is a spot-like opening, and the substrate material is subjected to isotropic etching through the spot-like opening to provide the etch profile.

In another aspect of the present invention, the opening formed in the mask layer is an elongate opening, and the substrate material is subjected to etching through the elongate opening to provide the etch profile.

In still another aspect of the present invention, the substrate material is subjected to etching, that has different etch rates dependent on the directions of crystal axes of the substrate material, through the opening in the mask layer to provide the etch profile, the etch profile comprising a central portion which has a spherical surface, and a peripheral portion which has a non-spherical surface having the smaller curvature in at least partial region thereof in the depthwise direction than that of the central spherical surface.

In a further aspect of the present invention, after obtaining the lens surface, the outer peripheral portion of the lens surface is subjected to etching again with the lens surface covered with a mask layer.

In a still further aspect of the present invention, a plurality of openings is formed in the mask layer to form a plurality of lens surfaces in the lens body correspondingly.

In yet another aspect of the present invention, an acoustic matching layer comprising a thin film formed of a material different from the substrate material is disposed on at least the lens surface of the lens body.

With the present invention thus arranged, the lens surface of very small curvature can precisely be processed by defining the lens surface of the acoustic lens with the etch profile, which is obtained by etching the substrate material. This etching process to define the lens surface can be implemented by using the etching technology customary in the conventional manufacture of semiconductors, and hence can be realized easily.

By carrying out isotropic etching through a spot-like opening formed in the mask layer, the resulting etch profile presents a semispherical surface of certain radius about the opening. The radius of the semispherical surface can be controlled with ease by controlling an etching time, and selected to be optionally over a range of several μm–1 mm and thereabout, for example.

Further, by carrying out etching through an elongate opening formed in the mask layer, the etch profile having a cylindrical surface can be resulted to enable fabrication of a cylindrical lens, where the opening is in a slit-like pattern. In this case too, the radius of the lens surface can be controlled with ease by controlling an etching time, and selected to be optionally over a range of several μm–1 mm and thereabout, for example. By selecting a proper pattern configuration of the opening and a proper etchant, it becomes possible to process various types of lens, such as a spherical lens, cylindrical lens, hybrid cylindrical lens, etc., which have different functions of condensing ultrasonic waves.

After obtaining the lens surface by etching, the outer peripheral portion of the lens surface is subjected to etching again with a mask layer coated on thereon, so that the curved surface following the etch profile is formed in the outer peripheral portion of the lens surface. Therefore, the outer peripheral edge of the lens surface defines a sharp ridgeline, thus reducing a level of the noise received through the outer peripheral portion of the lens surface.

Since the photolithography technique can be applied to any etching step carried out using a coated mask layer, it becomes possible to define a plurality of openings in the mask layer and form a plurality of lens surfaces in the lens body corresponding to the openings one-to-one, thereby densely and/or precisely arraying a plurality of lenses in the same substrate to obtain a two-dimensional image of a sample and different sound images at the same time.

Further, by providing an acoustic matching layer on the lens surface formed with etching to reform the lens surface, the transmission efficiency of acoustic energy through the lens surface can be improved.

The present invention also includes such a lens surface that is formed by etching the substrate material through an opening in the mask layer at different etch rates dependent on the directions of crystal axes of the material. This feature will be described below.

Generally, etching is grouped into two types based on whether the etch rates are almost independent of or dependent on the directions of crystal axes of the material; the former is called isotropic etching and the latter called unisotropic etching. For example, single-crystal silicon is subjected to isotropic etching in case of using a mixture of fluoric acid, nitric acid and acetic acid as an etchant, and to unisotropic etching in case of using an aqueous solution of KOH as an etchant. Even with the so-called isotropic etching, however, etch rates are not perfectly independent of the directions of crystal axes, but are different to some degree dependent on the directions of crystal axes. The degree of difference in etch rates is changed with the mixing ratio of an etchant, an etching temperature and other parameters. When using the aforesaid mixture of fluoric acid, nitric acid and acetic acid, for example, the lesser the ratio of fluoric acid, the larger will be the degree of difference in etch rates dependent on the directions of crystal axes. Likewise, as general characteristics, the higher the etching temperature, the smaller will be the degree of difference in etch rates dependent on the directions of crystal axes. But, the degree of difference in etch rates in these cases is much smaller than that obtainable with unisotropic etching. One aspect of the present invention proposes to carry out etching that has the relatively large difference in etch rates dependent on the directions of crystal axes, by the use of an etchant which exhibits the so-called isotropic etching. In this specification, for convenience of description, this type etching is expressed as "etching that has different etch rates dependent on the directions of crystal axes" or "pseudo-isotropic etching".

The inventors have discovered the fact that by carrying out such pseudo-isotropic etching through an opening in a mask layer, the unique etch profile can be formed which consists of a spherical central portion, and a non-spherical peripheral portion in which at least its partial region in the depthwise direction has smaller curvature than that of the spherical central portion. The present invention has been made based on this discovery.

In an acoustic lens equipped with the lens surface having the etch profile thus resulted, ultrasonic waves propagating straight from a piezoelectric transducer are focused on the axis of the lens surface through the lens central portion which has the spherical surface, thereby allowing an image to be observed similarly to the prior art in case of application to ultrasonic microscopes. On the contrary, since the non-spherical surface of the lens peripheral portion has smaller curvature in at least its partial region in the depthwise direction than that of the spherical surface of the lens central portion, those ultrasonic waves passing through the peripheral non-spherical surface tend to focus on a deeper position than the focus of those ultrasonic waves passing through the central spherical surface. The former ultrasonic waves are reflected by a sample surface and returned to the lens surface. At this time, the reflected ultrasonic waves are returned to not the peripheral non-spherical surface, but the central spherical surface due to the fact that their reflected points on the sample surface are offset from the axis of the lens surface, so that those ultrasonic waves will not propagate through the lens body in parallel to the axis of the lens surface because of the central spherical surface having the position of focus different from that of the peripheral non-spherical portion, and hence will be kept from reaching the piezoelectric transducer. Accordingly, there can be obtained information that is given by only those ultrasonic waves passing through the central spherical surface, while information that is given by those ultrasonic waves passing through the peripheral non-spherical surface becomes very scarce. In other words, the peripheral non-spherical portion serves like an edge in the conventional acoustic lens, resulting in a reduction of the noise received through the outer peripheral portion of the lens surface.

Further, the acoustic lens formed to have the above-mentioned configuration can eliminate the need of processing the spherical peripheral portion into an edge, and hence the manufacture of the acoustic lens can be more facilitated.

DESCRIPTION OF THE PREFERRED EMBODIMENTS

Hereinafter, the manufacture method of an ultrasonic probe according to one embodiment of the present invention will be described with reference to FIGS. 1*a*–1*f*.

In this embodiment, silicon single crystal is used as a lens body constituting acoustic lenses. Silicon has several advantages of high sound speed up to 8400 m/s therein, large refractive index of the lens body, and small attenuation of acoustic energy in its single crystal.

Figure 1A:
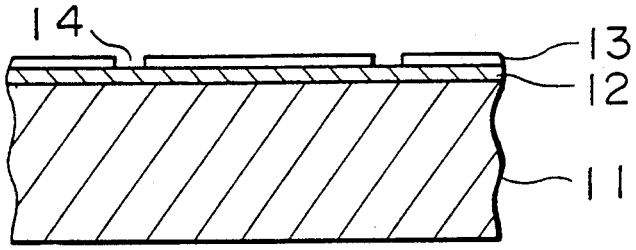
FIGS. 1*a*–1*f* are successive step views showing a manufacture method of acoustic lenses for an ultrasonic probe according to one embodiment of the present invention.
Figure 1B:
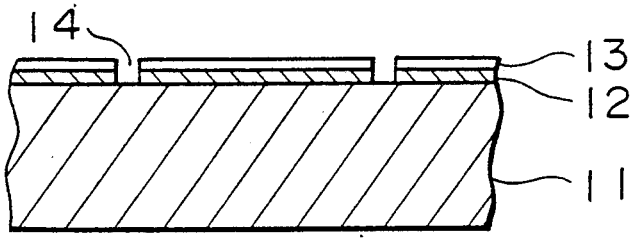

In a first step of lens processing, as shown in FIG. 1*a*, a layer 12 of chromium and gold is vapor-deposited as a mask layer for etching on the surface of a silicon single-crystal substrate 11. The chromium layer is about 200 Å thick and the gold layer is about 200 Å thick. Then, a resist film 13 is coated thereon, and the photo-lithography technique is employed to form a plurality of spot-like openings 14 each locating at the center of a lens spherical surface to be formed. The opening 14 is about 10 μm diameter. Etching is carried out through the openings 14 in the resist film 13 to bore corresponding spot-like openings in the mask layer 12 of chromium and gold as well. Hereinafter, the openings in the resist film and the mask layer will be denoted by numeral 14 collectively. An aqueous solution of iodine and ammonium iodide is employed as an etchant for gold, and an aqueous solution of cerium ammonium nitrate is employed as an etchant for chromium.

Figure 1C:
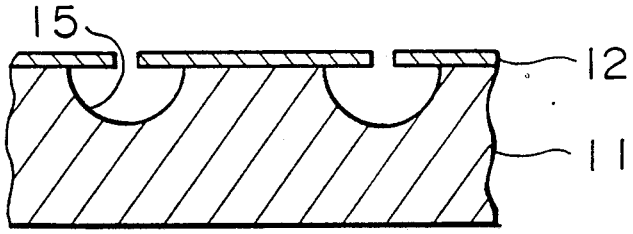

Next, after removing the resist film 13, the silicon single-crystal substrate 11 is subjected to etching through the openings 14 using the mask layer 12 of chromium and gold. At this time, it is important to select such an etchant that has an etch rate independent of the orientation of crystal. Employed herein is an etchant comprising a mixture solution of nitric acid (64%), acetic acid (60%) and fluoric acid (50%) mixed in the ratio of 4:3:1. Etching proceeds isotropically from each opening 14 of about 10 μm diameter to provide a semispherical etch profile 15 as shown in FIG. 1*c*. The resulting spherical lens of 200 μm diameter has a less than 1% error in the radius of curvature.

Figure 1D:
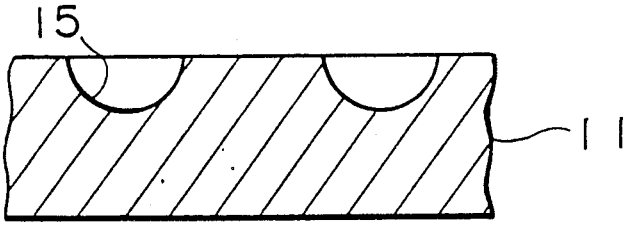
Figure 1E:
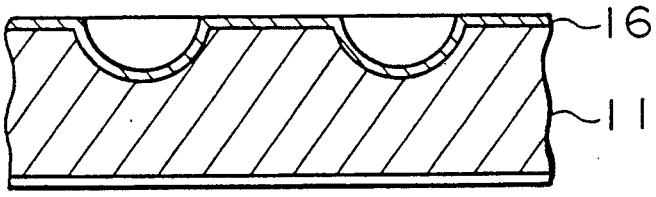

Next, by removing the mask layer 12 of chromium and gold, the semispherical surface appears as shown in FIG. 1*d*. While this semispherical etch profile 15 can directly be employed as a lens surface, an oxide film i.e., $SiO_2$ film, 16 is formed thereon in this embodiment. The purpose of this step is to form $SiO_2$ film, which has a lower sound speed, in a thickness of $\frac{1}{4}$ wavelength, for thereby transmitting acoustic energy to a medium with high efficiency. Because of using ultrasonic waves of 1 GHz, the $SiO_2$ film 16 with sound speed of 6000 m/s is here formed to be 1.5 μm thick. The $SiO_2$ film 16 is 1.5 μm thick can be formed by heating the substrate at about 1100° C. in the atmosphere of oxygen for about 6 hours. As a result, as shown in FIG. 1*e*, the $SiO_2$ film 16 is formed in a uniform thickness throughout over the surface of the substrate.

Figure 1F:
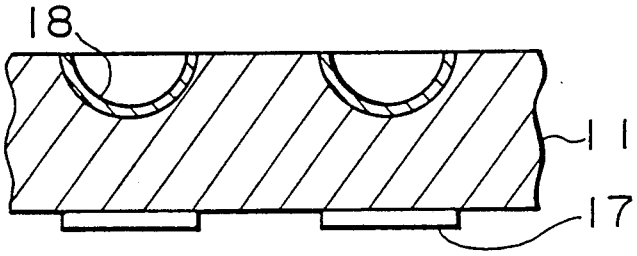

After that, by removing the $SiO_2$ film on the unnecessary portions and then forming piezoelectric transducers 17 on the rear surface of the substrate, there can be completed an acoustic lens system equipped with spherical lens surfaces 18, as shown in FIG. 1*f*. The desired lens configuration can be obtained by cutting the substrate 11 into pieces and machining them appropriately.

Figure 2:
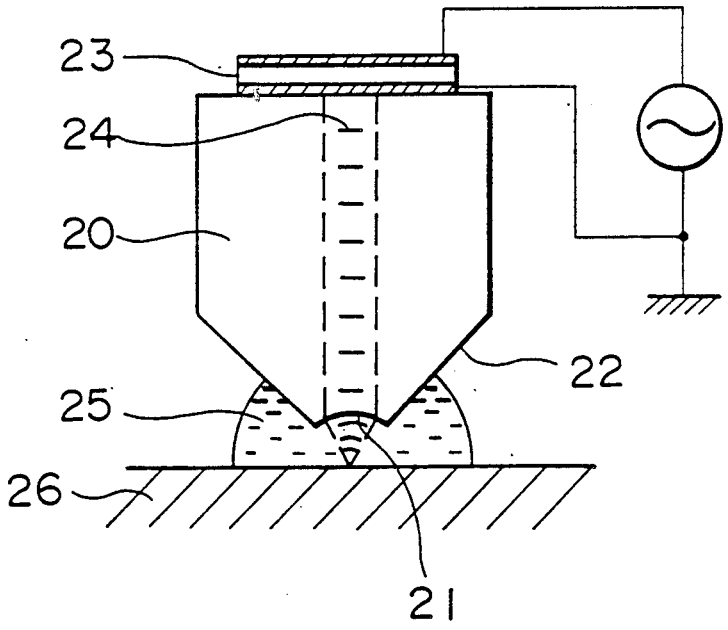
FIG. 2 is a side view of the ultrasonic probe constituted by using the acoustic lens.

FIG. 2 shows the simplified structure of the ultrasonic probe constituted by using the acoustic lens thus fabricated.

In FIG. 2, the ultrasonic probe comprises a lens body 20 constituting the acoustic lens. The lens body 20 is equipped at its one end with a spherical lens surface 21 which has been fabricated through etching as set forth above. The outer peripheral portion of the lens surface 21 is tapered to form a tapered surface 22. At the other end of the lens body 20, there is disposed a piezoelectric transducer 23 comprising a piezoelectric film, an upper electrode and a lower electrode.

When an RF electric signal is applied to both the upper and lower electrodes of the piezoelectric transducer 23, the piezoelectric film generates ultrasonic waves of frequency corresponding to its film thickness. These ultrasonic waves propagate in the form of plane waves 24 through the lens body 20 and then condensed to a certain focus by a positive lens constituted by the interface between the lens surface 21 and a medium, i.e., water 25. At this time, because the acoustic matching layer 16 is formed on the lens surface 21, there can be obtained the lens interface having the good efficiency of energy transmission. The ultrasonic waves are reflected by such a portion (e.g., void or crack) on the surface of a sample 26 that has different acoustic impedance, followed by returning of the reflected waves to the lens surface 21 of the lens body 20, and then detection of the reflected waves by the piezoelectric transducer 23. The detected signal is amplified by a receiver to provide information of the sample 26. By scanning a sample stage including the sample 26 rested thereon in the X- and Y-directions, surface information of the sample 26 can be obtained.

While the above case has been described as cutting a single lens out of the acoustic lens system of FIG. 1*f*, the structure of FIG. 1*f* can directly be employed when a lens system of two-dimensional array is required. One of important advantages of the present invention is in that individual lenses can two-dimensionally be arrayed with high precision using the photolithography technique. The array error of center-to-center distance of the lenses is less than about 0.5 μm with respect to the pitch of 1 mm. Use of such acoustic lens having a number of spherical lenses arrayed with high precision makes it possible to easily obtain a two-dimensional image of the sample and also increase the speed of two-dimensional image scanning.

Figure 3:
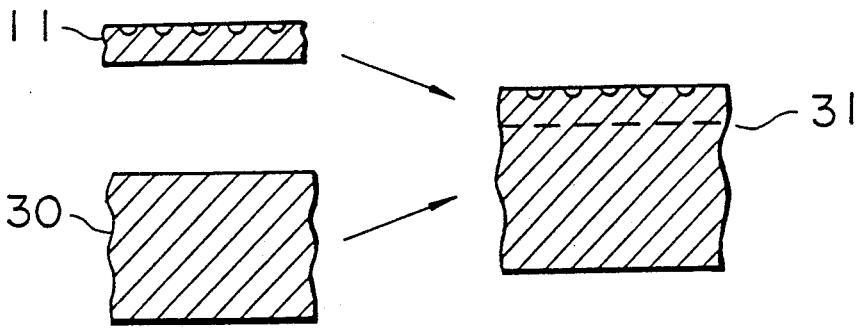
FIGS. 3, 4 and 5 are views showing modified applications of the embodiment.

The practical implement of fabricating the acoustic lenses according to the above embodiment will be described below with reference to FIG. 3. The thickness of a silicon wafer that can be processed by photolithography is usually in a range of about 0.3–0.4 mm. On the other hand, acoustic lens are required to be several millimeters thick in some cases. In such cases, the silicon single-crystal substrate 11 having the semispherical surfaces formed thereon by the above-mentioned process can be joined with another single-crystal silicon wafer 30, as shown in FIG. 3. On this occasion, a joined interface 31 therebetween can be single-crystallized without containing any inclusions by effecting the diffusion junction under about 1000 ° C. with crystal orientations of the substrate and the wafer held aligned with each other. This technique makes it possible to fabricate the lens body which has any desired thickness.

Figure 4:
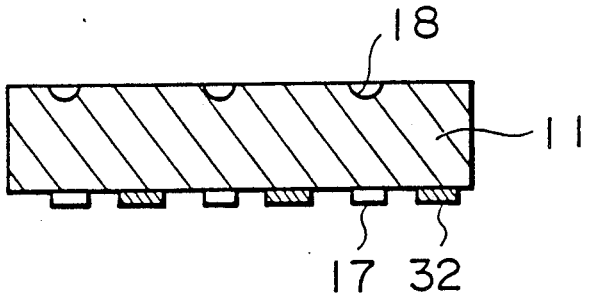

Another advantage of the foregoing embodiment is in that since the lens body is formed of silicon single crystal, an electronic circuit can be formed in a portion of the lens body. FIG. 4 shows an embodiment taking such an advantage. Thus, the semispherical lens surfaces 18 are present on the front surface of the silicon substrate 11, whereas the piezoelectric transducers 17 and electronic circuits 32 for driving the associated piezoelectric transducers 17 and processing signals are disposed on the rear surface side by side. As a result, integration of the acoustic spherical lenses becomes feasible.

Figure 5:
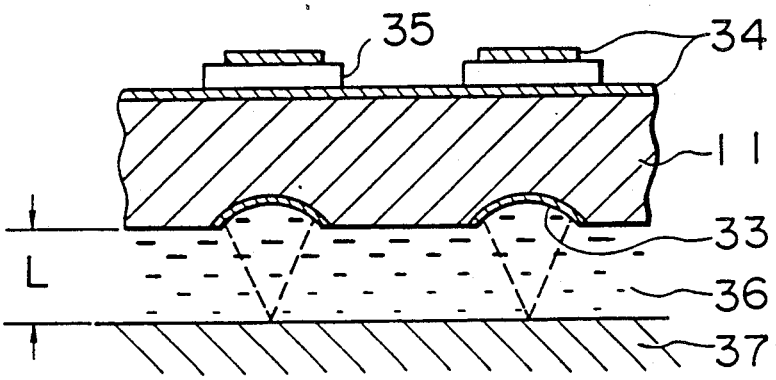

While the resulting lens surface is semispherical in the foregoing embodiments, it may be formed into a spherical shape in which an aperture size of the lens surface is smaller than the diameter of the spherical surface, as shown in FIG. 5, in case of taking a longer working distance between the sample and the lens. This structure can be obtained by grinding the surface of the substrate 11 on the lens surface side by a required amount during the above process between the steps of FIGS. 1*e* and 1*f*. In this case, as shown in FIG. 5, on the side of the substrate opposite to the lens surface 33, there are disposed piezoelectric transducers each of which comprises upper and lower electrodes 34 formed of metal thin films (gold and chromium), and a piezoelectric substance (zinc oxide) 35 sandwiched between the two electrodes. When an RF electric signal is applied between the two electrodes 34, the piezoelectric substance 35 generates ultrasonic waves that are focused and irradiated on a sample 37 through a medium 36, as illustrated.

With that construction, the ultrasonic waves are allowed to condense to the focus within the sample by reducing a distance L between the substrate 11 and the sample 37, which is suitable for observing the internal structure of the sample.

While the vapor-deposited film of chromium and gold is employed as the mask layer for isotropic etching in the foregoing embodiments, it will be apparent that a film of silicon nitride ($Si_3N_4$) or the like can also be employed as a mask material for an etchant comprising nitric acid. Further, the sort of etchant is not limited to the above ones, and the similar effect is obtainable so long as the etchant used exhibits isotropic etch rates.

On the other hand, the substrate material is not limited to silicon single crystal, and the similar acoustic lens can be fabricated using polycrystalline silicon, for example. In this case, the isotropic property of etching is improved, but the acoustic characteristics are degraded. It will be apparent that spherical lenses can be processed in a like manner using an etchant which has isotropic etch rates, even when the substrate is formed of any other sort of material.

As described above, the embodiments shown in FIGS. 1–5 can provide the advantageous effects below.

(1) Application of the etching process enables fabrication of an acoustic spherical lens with the very small radius of curvature, which have been incapable of being fabricated in the past.

(2) Use of the photolithography technique enables to array a number of spherical lenses on the same plane surface with high precision, and increase the speed of two-dimensional image scanning for obtaining a two-dimensional image of the objective to be measured.

(3) The lens interface having the good efficiency of energy transmission can be obtained.

(4) A multiplicity of lenses can be processed at a time, which leads to the high valuable economic effect in the practical production.

The manufacture method of a ultrasonic probe according to another embodiment of the present invention will be described with reference to FIGS. 6*a*–6*e*. In this embodiment too, a lens body is formed of silicon single crystal.

Figure 6A:
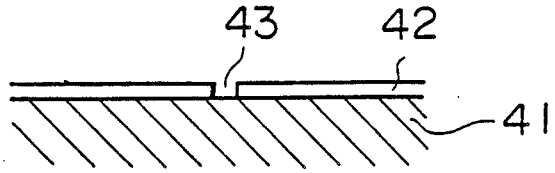
FIGS 6*a*–6*e* are successive step views showing a manufacture method of acoustic lenses for an ultrasonic probe according to another embodiment of the present invention.

In a first step of lens processing, as shown in FIG. 6*a*, a layer 42 of chromium and gold is vapor-deposited as a mask layer for etching on the surface of a silicon single-crystal substrate 41. The chromium layer is about 200 Å thick and the gold layer is about 2000 Å thick. Then, the photolithography technique is employed to form an opening 43 in any desired shape. In case of obtaining a spherical lens, for example, a circular opening of about 10 μm diameter is formed.

Figure 6B:
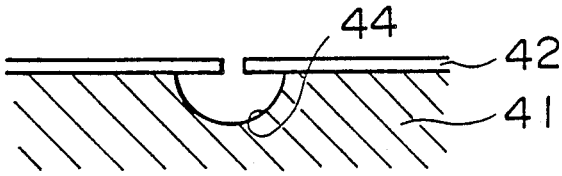

Next, etching is carried out through the openings 43 using the mask layer 42 of chromium and gold. At this time, it is important to select such an etchant that has an etch rate independent of the orientation of crystal. Employed herein is an etchant comprising a mixture solution of nitric acid (64%), acetic acid (60%) and fluoric acid (50%) mixed in the ratio of 4:3:1. Etching proceeds isotropically from that opening 43 in the mask layer 42 to provide a semispherical etch profile 44 as shown in FIG. 6*b*. The resulting spherical lens of 200 μm diameter has a less than 1% error in the radius of curvature. By removing the mask layer 42 of chromium and gold, the spherical surface comprising etch profile 44 can be obtained. A portion of that spherical surface serves as a lens surface.

The foregoing steps are substantially the same as those shown in FIGS. 1*a*–1*f* in the embodiment mentioned above.

Figure 6C:
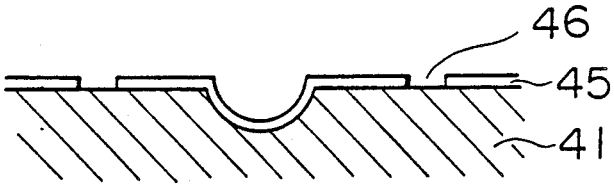

Next, processing to sharpen the outer peripheral edge of the lens takes place. To this end, as shown in FIG. 6*c*, the surface of the substrate 41, on which the aforesaid semispherical surface has been formed, is coated again with a mask layer 45 of chromium and gold. A portion of the mask layer 45 corresponding to a ring-like region 46 spaced from the center of the etch profile, i.e., the lens surface 44, by a certain distance is then removed.

Figure 6D:
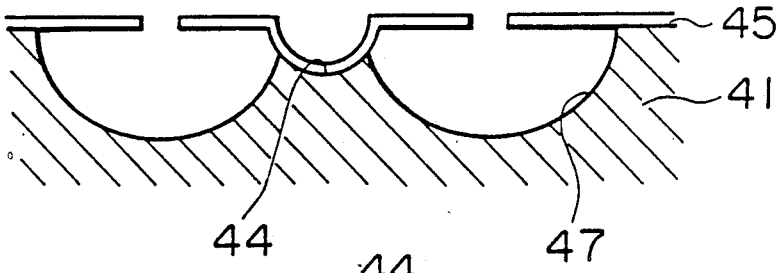

After that, the substrate is entirely subjected to etching using the same etchant as previously employed. By so doing, the substrate 41 is etched through the ring-like region 46 to provide an etch profile 47 merging with lens surface 44, as shown in FIG. 6*d*. Thus, the outer peripheral edge of the lens surface 44 is processed into a sharp profile.

Figure 6E:
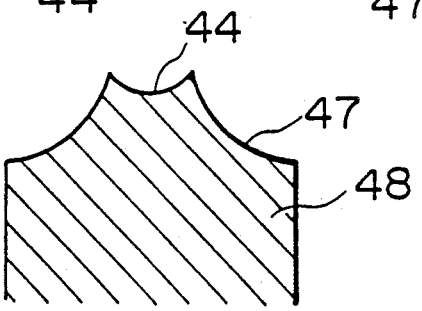

Finally, by removing the mask layer 45 and cutting the substrate into pieces each having the outer configuration of a lens, there can be obtained an acoustic lens 48 of desired shape, as shown in FIG. 6*e*. As with the first embodiment, an ultrasonic probe is then completed by arranging a piezoelectric transducer on the rear surface of the lens.

Non-spherical lenses, such as cylindrical lenses or hybrid cylindrical lenses, or a lens array comprising the combination of these lenses can be fabricated with the similar process as the above. Opening shapes of respective mask layers used in these cases are illustrated in FIGS. 8–10 in comparison with the opening shapes of the mask layers, used in fabricating the spherical lens, shown in FIG. 7.

Figure 7A:
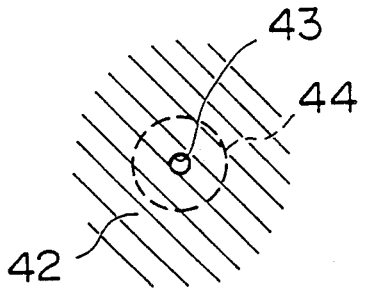
FIGS. 7*a* and 7*b* are views showing the shapes of first and second mask layers used in the embodiment of FIG. 6, respectively.
Figure 7B:
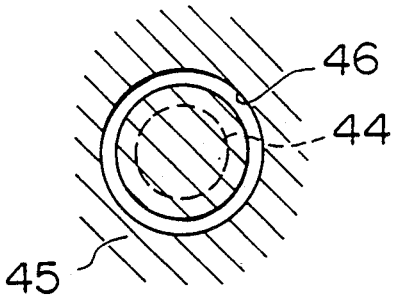
Figure 8A:
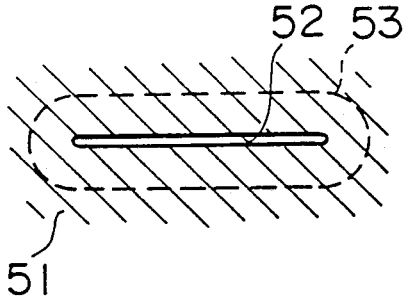
FIGS. 8*a* and 8*b*, FIGS. 9*a* and 9*b*, and FIGS. 10*a* and 10*b* are views similar to FIGS. 7*a* and 7*b*, showing the shapes of first and second mask layers used in respective modified applications of the embodiment of FIG. 6.
Figure 8B:
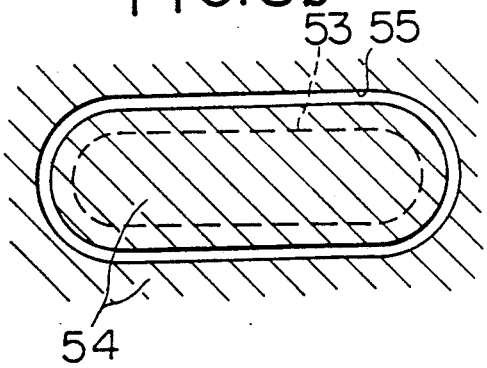

The first mask layer 42 used in fabrication of the spherical lens has the small circular opening 43 as shown in FIG. 7*a*. The second mask layer 45 in this case has the ring-like opening 46 while covering the semispherical etch profile 44, as shown in FIG. 7*b*. Meanwhile, a first mask layer 51 used in fabrication of the cylindrical lens has a slit-like opening 52 as shown in FIG. 8*a*, for thereby providing a semi-cylindrical etch profile 53. A second mask layer 54 in this case has an oval opening 55 in a position spaced from the etch profile 53 by a certain distance, while covering the etch profile 53, as shown in FIG. 8*b*. By so doing, the outer peripheral edge of the cylindrical lens is sharpened as with the case of the spherical lens.

Figure 9A:
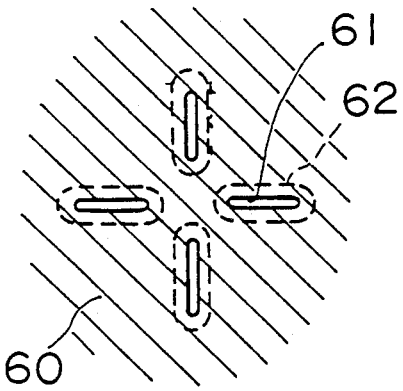
Figure 9B:
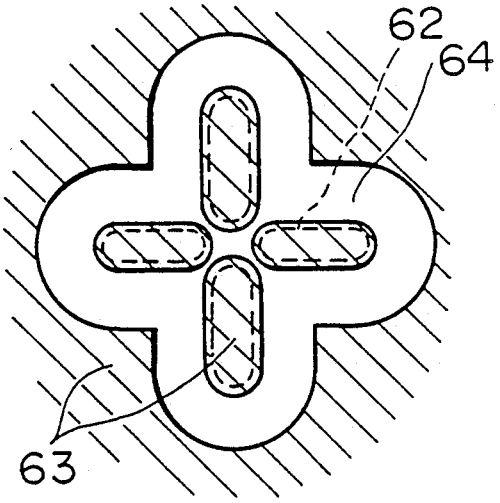

FIG. 9*a* and 9*b* show respective opening shapes of first and second mask layers used when fabricating four cylindrical lenses on the same substrate, the cylindrical lenses having their axes circumferentially spaced 90° from each other. The first mask layer 60 has four slit-like openings 61 to provide four cylindrical etch profiles 62, each opposite pair of which has the common axis. The second mask layer 63 used for sharpening the outer peripheral edges of those cylindrical surfaces has an opening 64, which like openings 46 and 55, is spaced from the peripheral edge of each etch profile 62 by a certain distance, while covering the etch profiles 62. The shape of the opening 46, 55, 64 required to be defined, on the inner peripheral side thereof, is constantly kept a certain distance from the peripheral edge of each etch profile 62, but it may have any optional extension on the outer peripheral side.

Figure 10A:
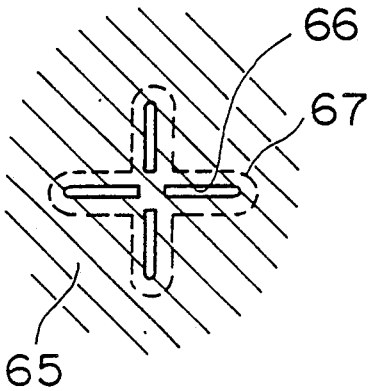
Figure 10B:
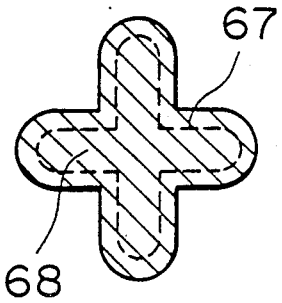

FIGS. 10*a* and 10*b* show an example in which the four slit-like openings defined in the first mask layer as set forth above are approached to each other. More specifically, a first mask layer 65 has four slit-like openings 66 whose inner ends are located closely to each other, thereby providing an etch profile 67 which comprises two elongate cylindrical lenses crossing at an angle of 90°, as shown in FIG. 10*a*. In this case, a second mask layer 68 has a crucial shape to cover the crossed etch profile 67, as shown in FIG. 10*b*.

The focusing beam of ultrasonic waves, resulted from the lens surface thus comprising two cylindrical surfaces arranged to have their axes crossing at a right angle, can present the equivalent effect to that obtainable with the case of perpendicularly superposing two one-dimensional focusing beams (or line focusing beams—see J. Kushibiki et al.: Electron Letters, vol. 17, No. 15; 520–522 (1981)), which have conventionally been employed. In other words, it becomes possible to concurrently measure respective sound speeds in the directions of two axes crossing orthogonally at the measured point, with the result that anisotropy of a solid can be measured easily.

Figure 11:
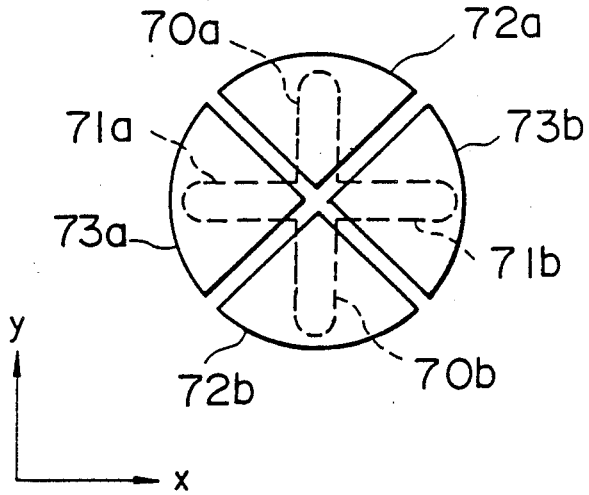
FIG. 11 is a view showing the relationship between a cylindrical lens and a piezoelectric transducer in the case of adopting the mask patterns shown in FIGS. 10*a* and 10*b*.

It should be herein noted that a piezoelectric transducer formed on the rear surface of lens has to be divided into pieces for the above acoustic lens of crucial shape. An embodiment to cope with this point is shown in FIG. 11. More specifically, four piezoelectric transducers 72*a*, 72*b* and 73*a*, 73*b* are disposed on the rear side corresponding to two pairs of cylindrical lenses 70*a*, 70*b* and 71*a*, 71*b*, one pair crossing the other pair at a right angle. Assuming that the direction of arrangement of the cylindrical lenses 70*a*, 70*b* are given by y and the direction of arrangement of the cylindrical lenses 71*a*, 71*b* are given by x, the piezoelectric transducers 72*a*, 72*b* are arranged in the y-direction to carry out transmission and reception for the cylindrical lenses 70*a*, 70*b*, respectively, and the piezoelectric transducers 73*a*, 73*b* are arranged in the x-direction to carry out transmission and reception for the cylindrical lenses 71*a*, 71*b*, respectively.

Use of the acoustic lens thus fabricated make it possible to measure anisotropy at one point of the objective to be measured, without rotating the lens for the one-dimensional focusing beam, in a shorter period of time. By arraying a number of above lenses on a single lens body with appropriate intervals therebetween, the lens scanning can also be performed over a wide range in a short time.

It will be apparent that in this embodiment, similarly to the embodiments shown in FIGS. 1–5, a film of silicon nitride ($Si_3N_4$) or the like other than the vapor-deposited film of chromium and gold can also be employed as a mask material for an etchant comprising nitric acid to carry out isotropic etching. The sort of etchant is not limited to the above ones, and the similar effect can be obtained so long as the etchant used exhibits isotropic etch rates.

Further, the substrate material is not limited to silicon single crystal, and the similar result is obtainable with other materials such as quartz, sapphire, YIG, YAG, and crystallized quartz, which have been employed in the past. Particularly, this embodiment can be applied to the lens surface which has been ground mechanically like the prior art. Thus, after protecting the ground lens surface with a mask layer, the outer peripheral portion thereof is subjected to etching to sharpen the outer peripheral edge of the lens, thereby presenting the similar advantageous effect in the view point of reduction in the noise.

As described above, the embodiment shown in FIGS. 6–11 can provide the advantageous effects below.

(1) Application of the etching process enables fabrication of an acoustic spherical lens with the very small radius of curvature in order of several μm, which have been incapable of being fabricated in the past.

(2) Etching twice enables to sharpen the outer peripheral edge of the lens surface, and reduce the noise received through the outer peripheral edge of the lens surface.

(3) Use of the photolithography technique enables to array a plurality of lenses on the same plane surface with high precision. As a result, a sound image over a wide area can be obtained with scanning made once.

(4) Fabrication of the cylindrical lenses having their axes orthogonal to each other enables to present respective sound images of the cylindrical lenses in the two directions crossing to each other.

(5) A multiplicity of lenses can be processed at a time, which leads to the high valuable economic effect in the practical production.

The manufacture method of a ultrasonic probe according to still another embodiment of the present invention will be described with reference to FIGS. 12*a*–12*i*.

In this embodiment the lens material for the acoustic lens is silicon single crystal Si that is cheaper and higher quality (less dislocations or other defects) than sapphire. However, the lens material may be formed of any other material such as sapphire, YAG, YIG, crystallized quartz, and fused quartz, for example, so long as it satisfies the required acoustic property (sound speed, propagation loss, etc.).

Figure 12A:
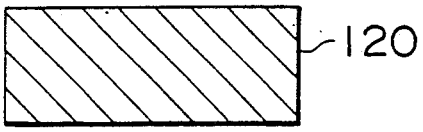
FIGS. 12*a*–12*i* are successive step views showing a manufacture method of acoustic lenses for an ultrasonic probe according to still another embodiment of the present invention.

To begin with, as shown in FIG. 12*a*, a wafer 120 is prepared which has the crystal axes strictly oriented. As one example of crystal orientation, an orientation flat 128 (see FIG. 13) is given by the (110) surface of a single-crystal wafer. The wafer, FIG. 15 has the (100) oriented surface. Incidentally, the wafer may have another crystal orientation, for example, such that the orientation flat 128 is given by the (100) surface. While the wafer may be of any desired size in a range compatible with the photolithography technique, the following description will be made on assumption that the wafer size is 3 inch (about 76 mm).

Figure 12B:
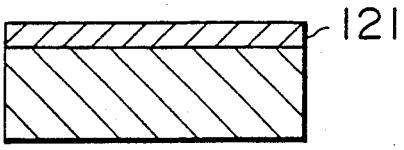
Figure 12C:
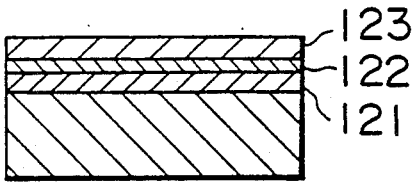

Next, the wafer 120 of 3 inch is placed in a thermal oxidation furnace where, as shown in FIG. 12*b*, a thermal oxidation film 121 of about 1.8 μm is formed on the surface of the wafer 120 as a substrate. With the vacuum deposition technique, as shown in FIG. 12*c*, a Cr film 122 is vapor-deposited on the substrate in thickness of about 1000 Å–1500 Å, and an Au film 123 is vapor-deposited on the Cr film 122 in thickness of about 3000 Å–20000 Å.

Figure 12D:
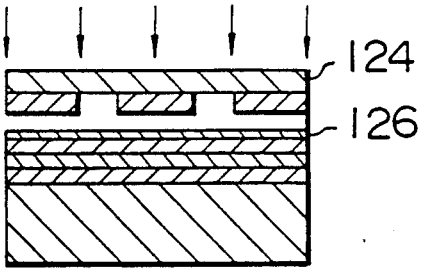
Figure 12E:
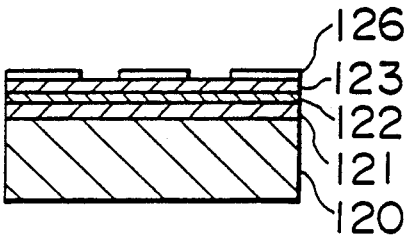

Subsequently, as shown in FIG. 12*d*, a resist film 126 is coated by a spinner in thickness of about 1 μm, and then exposed and developed using a glass mask 124 which has a predetermined mask pattern corresponding to the shape of openings (described later) in a mask layer. By so doing, a resist pattern corresponding to the mask pattern of the glass mask 124 is formed in the resist film 126, as shown in FIG. 12*e*.

Figure 12F:
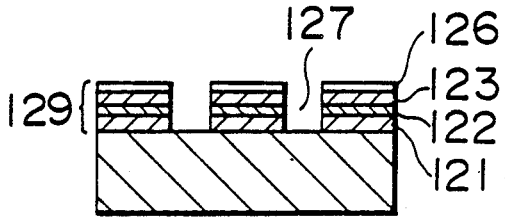
Figure 13:
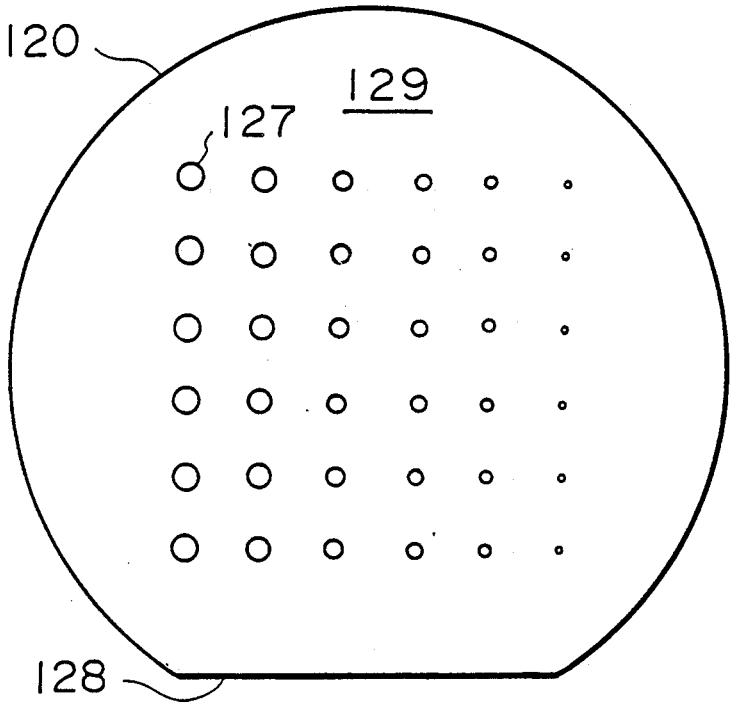
FIG. 13 is a plan view showing an opening pattern of a mask layer formed on a substrate in one step of the manufacture method of FIG. 12.

Next, as shown in FIG. 12*f*, the thermal oxidation film 121 as well as the Cr film 122 and the Au film 123, both vapor-deposited under vacuum, are subjected to wet-etching by the use of the resist film 126, which has the resist pattern thus obtained, as a mask material. An etchant available in such wet-etching is described in detail in the book of Kiyotake Naraoka, "Precise Microprocessing in Electronics", published by Comprehensive Electronic Publishing Co., Ltd., for example. As a result of wet-etching, spot-like openings 127 corresponding to the resist pattern of the resist film 126 are patterned in the thermal oxidation film 121 as well as the Cr film 122 and the Au film 123, both vapor-deposited under vacuum. Then removing the resist film 126 by an appropriate solution forms a mask layer 129 which comprise the thermal oxidation film 121, the Cr film 122 and the Au film 123, and which is sufficiently resistant against etching. Shapes and array pattern of openings thus defined in the mask layer 129 are shown in FIG. 13.

The mask layer 129 may be replaced by any another type of layer so long as it will not be eroded by a mixture solution of fluoric acid and nitric acid that is employed as an etchant for Si of the substrate 120. By way of example, a film of silicon nitride may be used. If the lens surface to be fabricated has the small radius of curvature, it is possible for the resist film 126 to serve as a mask.

Figure 12G:
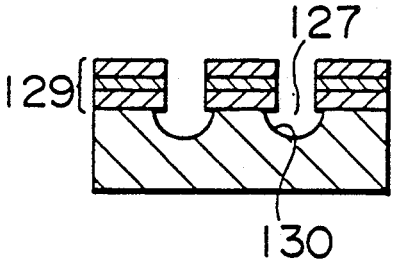

Next, the Si wafer is subjected to pseudo-isotropic etching using a mixture solution of fluoric acid, nitric acid and acetic acid, that is an etchant for Si, thereby forming a recess 127 defined by etch profile in a position corresponding to each opening 127 of the mask layer 129, as shown in FIG. 12*g*. At this time, the mixing ratio of the etchant is so selected as to present the relatively large difference in etch rates dependent on the directions of Si crystal axes. The preferable mixing ratio for a mixture solution of fluoric acid, nitric acid and acetic acid is given by 0.5:4.5:3 in volume ratio, for example. Note that other mixing ratios such as 0.2:4.8:3 or 2:3:3 are also available.

Figure 14A:
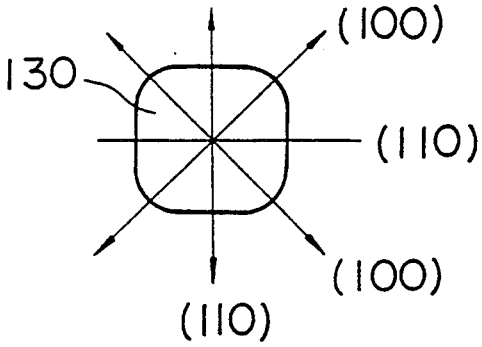
FIGS. 14*a* and 14*b* are a plan view and a sectional view showing the peripheral configuration of a recess defined by the manufacture method of FIG. 12, respectively.
Figure 14B:
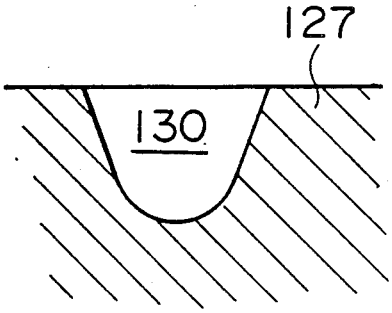

By using any mixing ratio that makes etch rates different dependent on the directions of crystal axes, the recess 130 formed in the substrate 120 presents the etch profile defined such that the peripheral portion of the recess has a nearly square opening, the central portion thereof is spherical, and the peripheral portion thereof has a non-spherical surface with its curvature gradually decreasing in the depthwise direction relative to the curvature of the spherical central portion, as shown in FIGS. 14*a* and 14*b*. The peripheral portion of the recess is also so defined in its horizontal section that the nearly square shape at the opening gradually transits to the circular shape at the central portion. The reason is as follows.

Figure 15:
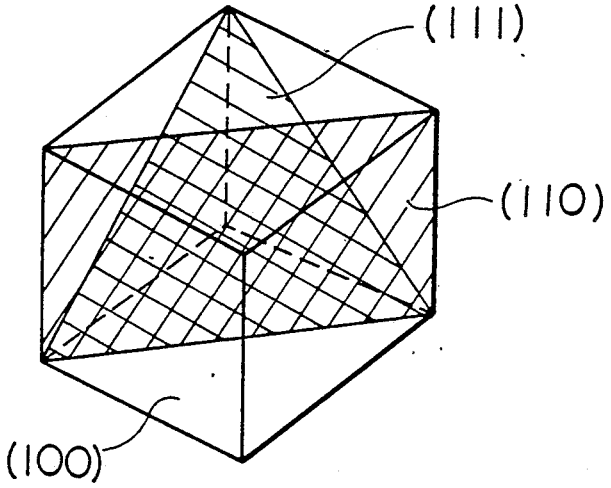
FIG. 15 is a view showing the crystal structure of single-crystal Si employed in the manufacture method of FIG. 12.

FIG. 15 shows the crystal structure of the Si single crystal wafer constituting the substrate 120, and three crystal surfaces (100), (110), (111). Etch rates of the wafer in the directions perpendicular to the respective crystal surfaces are given in the order of (100)>(111)>(110). In this specification, those directions perpendicular to the respective crystal surfaces are referred to as the directions of crystal axes. The difference in etch rates dependent on the directions of crystal axes is increased, as the content of fluoric acid in the etchant is reduced, and vice versa. Also, the higher the etching temperature, the smaller the difference in etch rates.

Since the surface orientation of the wafer constituting the substrate 120 is given by the (100) surface in this embodiment, as mentioned above, the arrangement of crystal surfaces shown in FIG. 15 results in that the (100) and (110) surfaces extending orthogonally to the horizontal obverse (100) surface are located alternately with circumferential intervals of 45° as illustrated in the plan view of FIG. 14*a*. At the opening peripheral portion of the recess in the substrate surface, therefore, the etch rate in the direction of (100) surface is higher than that in the direction of (110) surface, so that the opening shape becomes nearly square.

Figure 16:
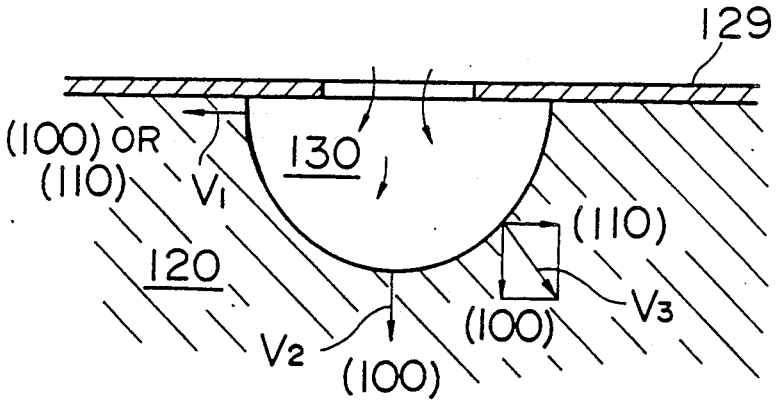
FIG. 16 is a depthwise sectional view of the recess, showing the process in which the recess is formed by the manufacture method of FIG. 12, in relation to etch rates.

On the contrary, the shape of the recess 130 in the depthwise direction is deviated from a spherical surface by the degree that corresponds to the difference in etch rates between the depthwise direction of the (100) surface and the horizontal direction of the (110) surface. More specifically, as shown in FIG. 16, the opening peripheral portion of the recess is subjected to an etch rate V1 in the direction of (100) or (110) surface, the bottom portion thereof is subjected to an etch rate V2 in the direction of (100) surface, and the intermediate portion thereof is subjected to a resultant etch rate V3 of both the etch rates V1 and V2. As a result, the region near the bottom or central portion of the recess has a spherical surface that is delimited by the etch rate V2 in the direction of (100) surface. On the other hand, in the intermediate region ranging from the opening portion to the bottom portion of the recess, since the etch rate is given by the resultant etch rate V3, the curvature does not become constant, and hence that region has a non-spherical shape with its curvature different from that of the bottom spherical surface. At this time, with the etch rates being in order of (100)>(110), the section as viewed in the direction of (110) surface is in the form of a relatively deep hole extending longer in the depthwise direction, and has a non-spherical surface which has the smaller curvature in at least partial region thereof than that of the bottom spherical surface. Meanwhile, the section taken along the direction of (100) surface has the same curvature as that of the central spherical surface because of (100)=(100) in horizontal and vertical etch rates. Thus, the horizontal section of the recess 130 gradually transits from the nearly square shape at the opening portion to the circular shape at the central portion.

As a result of the measurement conducted by using a Fizeau's interferometer, it has been confirmed that the $\frac{1}{4}$-$\frac{1}{3}$ region of the recess 130 from its center matches with a true spherical surface with the maximum error in order of laser wavelength (0.6 μm).

Here, since the degree of difference in etch rates dependent on the directions of crystal axes (or the directions of crystal surfaces) is determined by the mixing ratio of an etchant, the coverage percentage of the central spherical portion with respect to the entire recess can be adjusted by optionally selecting the mixing ratio. In this embodiment, therefore, the coverage percentage can be adjusted dependent on the contents of fluoric acid and nitric acid. With increasing the content of fluoric acid, the entire etched surface approaches a spherical surface. However, the finish (roughness) of the spherical surface is degraded. The area of the central spherical portion can be controlled with high reproducibility by fixing the mixing ratio of an etchant and the etching time.

Figure 12H:
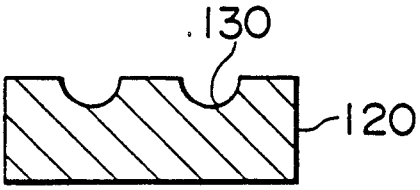
Figure 12I:
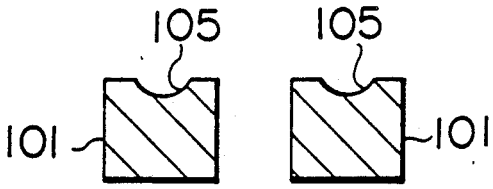

After the completion of etching of the recess 130, as shown in FIG. 12*h*, the Au film 123, the Cr film 122 and the $SiO_2$ film 121 are removed by etching in a like manner to the step of forming the mask layer 129 by etching. Thereafter, as shown in FIG. 12*i*, the substrate is cut out by means of a core drill about the recess 130, and the cut-out piece is finished to a predetermined lens configuration, thereby providing an acoustic lens 101. At this time, a lens surface 105 is constituted by the central spherical portion and at least one region of the peripheral non-spherical portion of the recess 130.

Next, an ultrasonic probe for an ultrasonic microscope constructed using the acoustic lens 101 thus fabricated will be described with reference to FIGS. 17 and 18.

Figure 17:
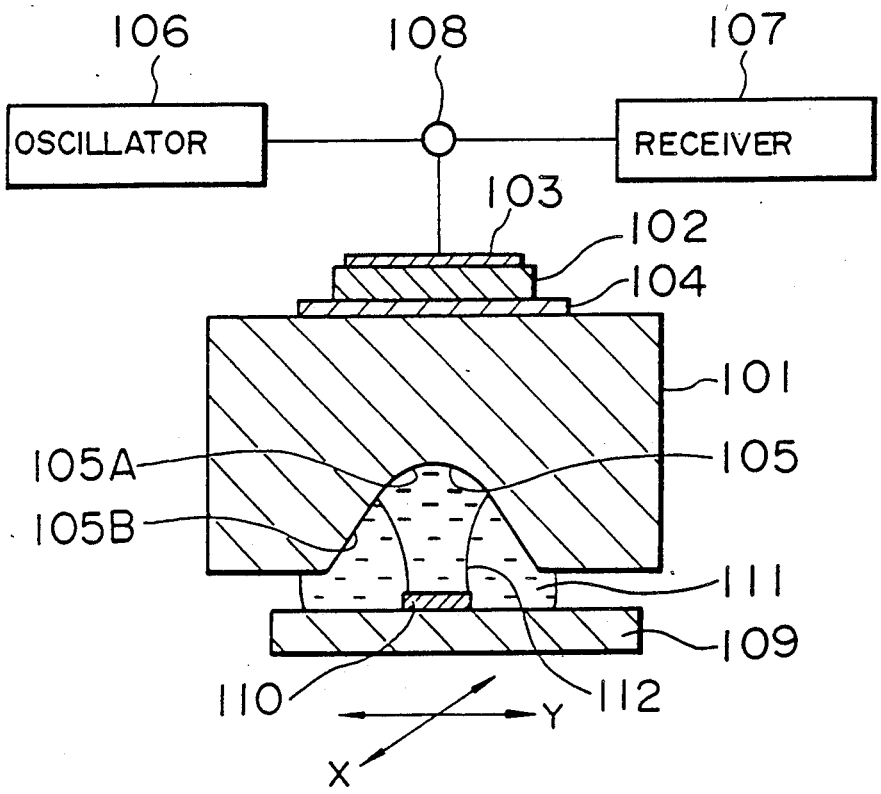
FIG 17 is a sectional view showing the ultrasonic probe constituted by using the acoustic lens fabricated by the manufacture method of FIG. 12.
Figure 18:
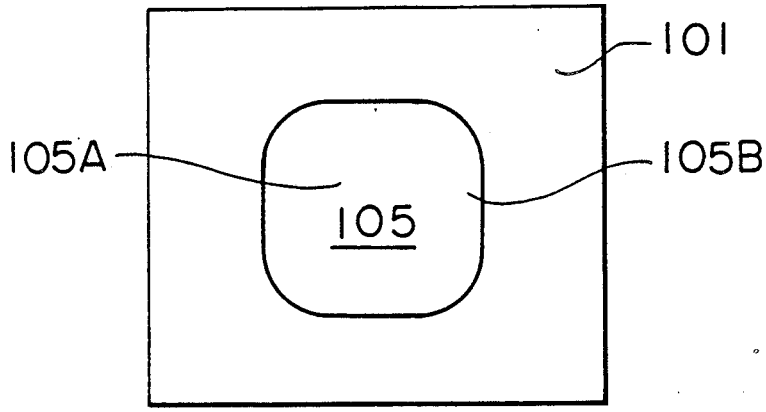
FIG. 18 is a bottom view of the acoustic lens of FIG. 17.

In FIG. 17, the ultrasonic probe comprises the acoustic lens or a lens body 101 constructed as set forth above, a piezoelectric film 102 provided on one side of the lens body 101 for generating ultrasonic waves, an upper electrode 103 and a lower electrode 104 for supplying power to the piezoelectric film 102, and a concave acoustic lens surface 105 formed on the other side of the lens body 101. The upper and lower electrodes 103, 104 are both connected to an oscillator 106 and a receiver 107. The connection line led to the oscillator 106 and the receiver 107 is changed over by a circulator 108. The acoustic lens surface 105 comprises a central portion 105A which has a spherical surface, and a peripheral portion 105B which has a non-spherical surface with its curvature gradually decreasing in the depthwise (downward) direction than that of the central portion. Further, the peripheral portion 105B has an opening shape that is nearly square, as shown in FIG. 18, and a horizontal cross section that is non-circular, i.e., transits from the nearly square shape to the circular shape of the spherical central portion 105A.

In operation, a sample 110 is placed on a sample stage 109 with water 111 filled between the sample 110 and the lens body 101.

To begin with, the oscillator 106 is energized to produce voltage in the form of pulse wave or burst wave, that is supplied to the piezoelectric film 102. Application of the voltage vibrates the piezoelectric film 102 to generate ultrasonic waves of frequency corresponding to a thickness of the piezoelectric film. The ultrasonic waves are condensed by the central spherical portion 105A of the concave acoustic lens surface 105 of the lens body 101 to form a focusing beam 112. The condensed ultrasonic waves are reflected by such a portion (e.g., void or crack) on the surface or the interior of the sample that has different acoustic impedance, followed by returning to the lens surface 105 of the lens body 101 again, and then detected by the piezoelectric film 102. The detected signal is amplified by the receiver 107 to provide information of the sample 101.

By scanning the sample stage 109 in the Y-direction and the lens body 101 in the X-direction, it is possible to obtain information about any desired planar position on the surface or in the interior of the sample 110.

Figure 19:
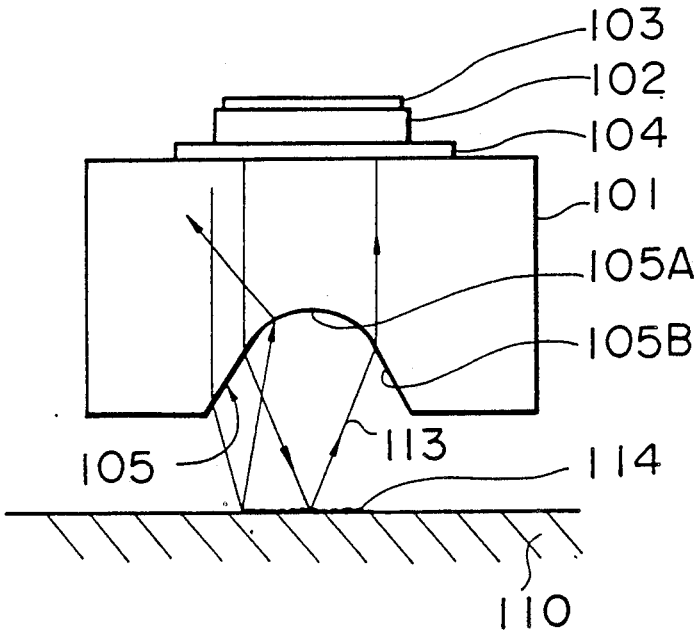
FIG. 19 is a view showing details of the propagation behavior of ultrasonic waves passing through the ultrasonic lens of FIG. 17.

FIG. 19 shows in detail the propagation behavior of the ultrasonic waves passing through the acoustic lens 101. Ultrasonic waves propagating straight from the piezoelectric film 102 are focused on the axis of the lens surface 105 through the central portion 105A of the lens surface which has the spherical surface, thereby allowing an image to be observed similarly to the prior art in case of application to ultrasonic microscopes. On the contrary, since the non-spherical surface of the lens peripheral portion 105B has the curvature gradually decreasing in the depthwise direction than that of the central spherical portion 105A, those ultrasonic waves passing through the peripheral non-spherical surface tend to focus on a deeper position than the focus of those ultrasonic waves passing through the central spherical surface. At this time, the ultrasonic waves are reflected by the sample surface to become reflected waves 113 or surface waves 114 dependent on the incident angle with respect to the sample surface, the reflected waves 13 being returned to the lens surface 105. But, the reflected waves 113 of those ultrasonic waves passing through the peripheral non-spherical surface are also returned to the central spherical portion 105A of the lens surface due to the fact that their reflected points on the sample surface are offset from the axis of the lens surface. The central spherical portion 105A has the position of focus different from that of the peripheral non-spherical portion 105B. Accordingly, those ultrasonic waves will not propagate through the lens body in parallel to the axis of the lens surface, and hence will be kept from reaching the piezoelectric film 102. As a result, there can be obtained information that is given by only those ultrasonic waves passing through the central spherical portion 105A, while information that is given by those ultrasonic waves passing through the peripheral non-spherical portion 105B becomes very scarce.

Further, the peripheral portion 105B has a non-circular shape in horizontal section. Therefore, those ultrasonic waves passing through the peripheral portion 105B propagate in the direction offset also laterally from the axis of the lens surface, and the reflected waves from the sample surface are returned to the lens in the direction offset correspondingly or diffused out of the lens. It is thus believed that the peripheral portion 105B in non-spherical horizontal section functions to scatter the ultrasonic waves.

Stated differently, the peripheral non-spherical portion 105B serves like an edge in the conventional acoustic probe based on at least the action produced by the depthwise shape thereof, or the combined effect of that action and another action produced by the non-circular horizontal section, thereby making it possible to reduce the noise received.

Thus, with this embodiment in which the peripheral portion 105B of the lens surface 105 has not a spherical surface, but a non-spherical surface with a non-circular section, there can be obtained information with less noise, and a clear image when employed in ultrasonic microscopes.

In addition, the lens surface 105 formed to have the above-mentioned configuration can eliminate the need of processing the spherical peripheral portion of the lens surface into a tapered edge, and hence the manufacture cost can be reduced greatly.

As described above, in accordance with the present invention, application of the etching process enables fabrication of a high-precision lens surface with the very small radius of curvature, which have been incapable of being fabricated in the past.

The peripheral non-spherical portion 105B serves like an edge in the conventional acoustic lens, thereby reducing the noise received an obtaining a sharp image when applied to ultrasonic microscopes.

Further, the acoustic lens formed to have the above-mentioned configuration can eliminated the need of processing the spherical peripheral portion of the lens surface into an edge, that was indispensable in the past, and hence a great reduction in the manufacture cost can be realized.

Use of the photolithography technique enables to simultaneously process 20–40 lens surfaces on a single Si wafer as shown in FIG. 13, so that the acoustic lenses with good reproducibility can be manufactured easily and inexpensively.

Moreover, by changing the mask shape of the glass mask 124 to vary the shape of the openings 128 in the mask layer 129, the peripheral portion of the recess 130 (lens surface 15) is adaptable for a variety of shapes, such as an ellipsoidal or octagonal shape, other than that shown in FIG. 14*a*.

While the surface orientation of the wafer constituting the substrate 120 is given by the (100) surface in the foregoing embodiment, it may be given by another surface as mentioned above. The recess configuration formed in case of using the (111) surface in place of the (100) surface will not be described below.

Figure 20:
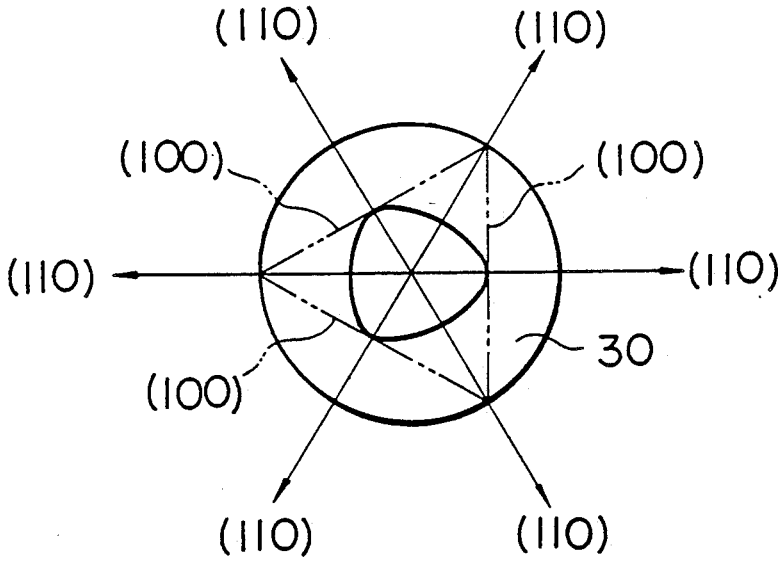
FIG. 20 is a top view showing the configuration of a recess in relation to the directions of crystal axes, when the surface orientation of a wafer is modified.

Assuming now that the surface orientation of the wafer constituting the substrate 120 is given by the (111) surface, the arrangement of crystal surfaces shown in FIG. 15 results in that only the (110) surfaces extending orthogonally to the horizontal obverse (111) surface are located with circumferential intervals of 60° as illustrated in the plan view of FIG. 20. At the opening peripheral portion of the recess in the substrate surface, therefore, the etch rates are equal to each other in all the directions, so that the opening shape becomes circular.

Figure 21:
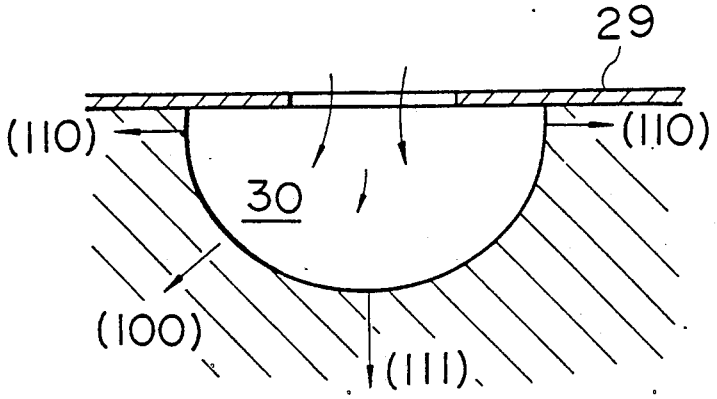
FIG. 21 is a depthwise sectional view of the recess in FIG. 20, showing the process in which the recess is formed, in relation to etch rates.

On the contrary, the shape of the recess 130 in the depthwise direction is deviated from a spherical surface by the degree that corresponds to the difference in etch rates among the depthwise direction of the (111) surface, the horizontal direction of the (110) surface, and the oblique direction of the (100) surface. More specifically, as shown in FIG. 21, the opening peripheral portion of the recess is subjected to an etch rate in the direction of (110) surface, the bottom portion thereof is subjected to an etch rate in the direction of (111) surface, and the intermediate portion thereof is subjected in some regions to a etch rate in the direction of (100) surface because of the presence of the (100) surfaces in a trigonal pyramid shape as indicated by imaginary lines in FIG. 20. As a result, the shape of the intermediate portion approaches to a trigonal pyramid in its deeper region. Even with such tendency, however, the region near the bottom or central portion of the recess has a spherical surface that is delimited by the etch rate in the direction of (111) surface. At this time, with the etch rates being in order of (111)>(110), the recess presents a relatively deep hole extending longer in the depthwise direction. As a result, the intermediate region ranging from the opening portion to the bottom portion of the recess becomes a non-spherical surface which has the smaller curvature in at least partial region thereof in the depthwise direction than that of the bottom spherical surface.

Thus, in this embodiment too, there can be obtained the configuration of the recess which comprises the central portion which has a spherical surface, and the peripheral portion which has a non-spherical surface having the smaller curvature in at least partial region thereof in the depthwise direction than that of the central spherical surface, the horizontal section of the peripheral portion being non-circular. Consequently, the acoustic lens with high performance can be realized like the above-mentioned embodiments.

Though not here described in detail, the configuration of the recess basically similar to the above one can also be obtained in the case where the surface orientation of the wafer constituting the substrate 120 is given by the (110) surface.

Ultrasonic probes according to still another embodiments of the present invention will be described below with reference to FIGS. 22–25.

Figure 22:
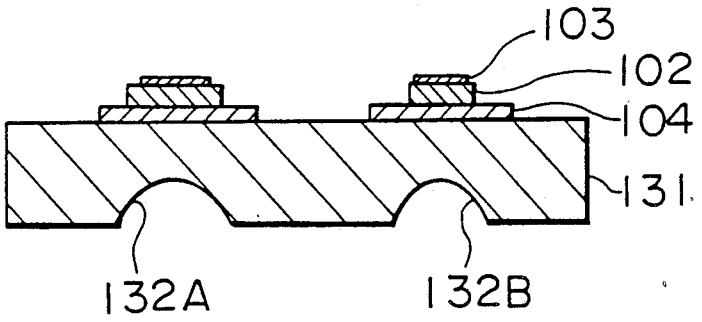
FIGS. 22–25 are sectional views showing ultrasonic probes in respective modified applications of the embodiment of FIG. 17.

FIG. 22 is an application example of the embodiment of FIG. 17 in which two or more lens surfaces 132A, 132B are provided on a single lens body 131 formed of a Si substrate, and the connection line to a transmitter and a receiver is changed over for providing a multiplicity of information at the same time.

Figure 23:
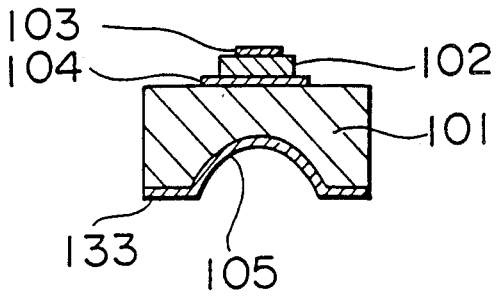

FIG. 23 shows an embodiment in which an acoustic matching layer 133 is formed on the side of the lens body 101 near the lens surface, the layer 133 comprising a thin film of $SiO_2$ formed through thermal oxidation. The thickness of this thin film is selected to be $\frac{1}{4}$ wavelength of the ultrasonic waves. The presence of the acoustic matching layer 133 contributes to reduce the loss of effective ultrasonic waves caused by the interface. The predetermined thickness of the $SiO_2$ matching layer can easily be obtained by using Si as a material of the lens body 101 and adjusting a period of thermal oxidation time.

Figure 24:
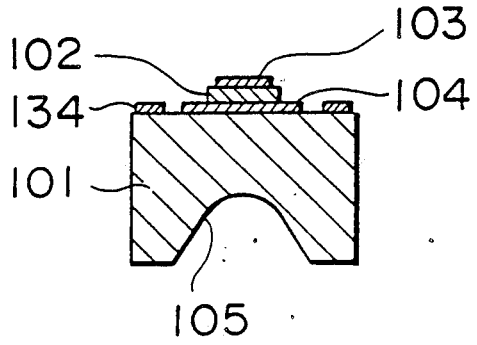

FIG. 24 shows an embodiment in which B (boron) or P (phosphorus) is doped into the surface, on which the piezoelectric transducer is to be formed, to thereby fabricate a preamplifier or transistor 134 by utilizing the nature of Si constituting the acoustic lens body 101. The provision of the preamplifier 134 can amplify the signal within a period in which the wavelength undergoes less distortion shortly after reception, and improve the S/N ratio. Where a number of lens surfaces are fabricated as shown in FIG. 22, respective channels can be changed over as required by providing the transistors 134. Thus, forming an electronic circuit on the lens body 101 enables fabrication of an intelligent ultrasonic probe.

Figure 25:
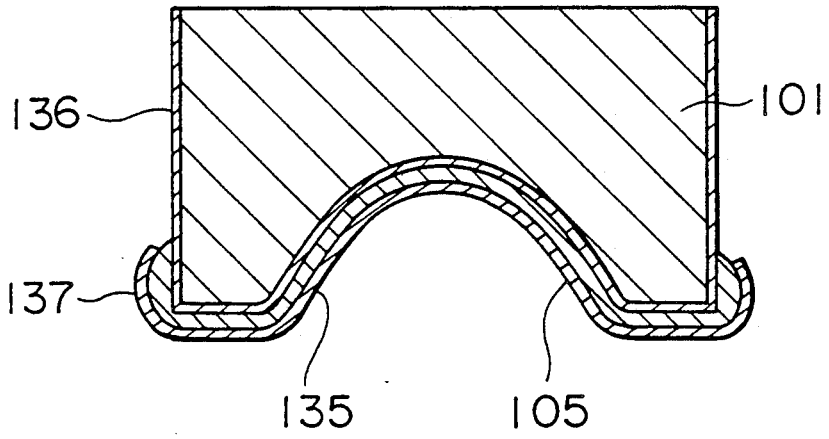

FIG. 25 shows an embodiment in which a piezoelectric film 135, a lower electrode 136 and an upper electrode 137 are provided on the same side of the acoustic lens body 101 as the lens surface 105. This reduces the propagation loss through the lens body 101, thereby providing an image with good S/N ratio.

Further, though not shown, the flat region of the acoustic lens body 101 on the same side as the lens surface 105, but except for the lens surface, may be processed to become a rough surface by etching that flat region for a short time using an etchant in which fluoric acid is richer, for example. This process prevents the ultrasonic waves from reaching the sample from the flat regions if they remain not roughed, and lowers a level of the noise.

As described above, the embodiments shown in FIGS. 12–25 can provide the advantages effects below.

(1) A number of acoustic lenses with good reproducibility can be obtained easily.

(2) Since the peripheral non-spherical portion of the lens surface serves as a conventional edge, the noise received through the outer peripheral portion of the lens surface can be reduced.

(3) Since there is no need of processing the edge that has faced difficulties in the past, the cost of the acoustic lens can be lowered.

(4) The degree of freedom in the lens configuration is increased to make the lens flexible in shape and length thereof following the objective to be measured.

(5) Provision of a number of lenses having equal characteristics enables fabrication of multiple channels to improve the scan speed.

(6) Addition of the acoustic matching layer formed of a thermal oxidation film enables fabrication of the lens with good efficiency.

(7) Forming the electronic circuit on the lens enables fabrication of the compact acoustic lens with high performance.

(8) By processing the flat region, other than the lens surface, to become a rough surface, the noise possibly received can further be reduced.

(9) By forming the piezoelectric film on the same side as the opening portion, there can be obtained an image with good S/N ratio.

What is claimed is:

1. An ultrasonic probe to be used to examine a sample, comprising:

an acoustic lens body of substrate material having a concave lens surface formed on one side of said acoustic lens body;

piezoelectric transducer means disposed on said acoustic lens body for generating ultrasonic waves in response to applying voltage to said piezoelectric transducer means and for focusing said ultrasonic waves through said lens surface to detect the reflected waves of said ultrasonic waves from the sample by said piezoelectric transducer means for obtaining information about the surface or interior of said sample; and said lens surface of said acoustic lens body being an etch profile on said substrate material of said acoustic lens body.

2. An acoustic probe according to claim 1, wherein the etch profile of said lens surface is spherical.

3. An acoustic probe according to claim 1, wherein said substrate material is crystaline with different crystal axes; the etch profile of said lens surface has different etch profile radii dependent on the directions of crystal axes of said substrate material; and said etch profile comprising a central portion which has a spherical surface, and a peripheral portion which has a non-spherical surface having the smaller curvature in at least partial region thereof in the depthwise direction than that of said central spherical surface.

4. An acoustic probe according to claim 1, wherein there are a plurality of said lens surfaces arrayed on said acoustic lens body, said plurality of lens surfaces being defined by respective etch profiles.

5. An acoustic probe according to claim 4, wherein said plurality of lens surfaces are outwardly concave with axes of their shapes intersecting with each other.

6. An acoustic probe according to claim 5, wherein said plurality of lens surfaces are disposed closely adjacent to or unified with each other around an axis of said lens body.

7. An acoustic probe according to claim 1, wherein said acoustic lens body further includes a concave border etch profile etched around the outer peripheral portion of said lens surface.

8. An acoustic probe according to claim 1, wherein said substrate material of said acoustic lens body is silicon.

9. An acoustic probe according to claim 1, wherein an acoustic matching layer comprising a thin film formed of a material different from said substrate material of said acoustic lens body is disposed on at least said lens surface of said acoustic lens body.

10. An acoustic probe according to claim 1, wherein said substrate material of said acoustic lens body is single-crystal silicon, and an acoustic matching layer comprising a thin film of $SiO_2$ is disposed on at least said lens surface of said acoustic lens body.

11. An acoustic probe according to claim 8, wherein said lens body is made up by a plurality of silicon substrates joined to each other.

12. An acoustic probe according to claim 8, further including an electronic circuit utilizing said silicon that is a material of said lens body.

13. An acoustic probe according to claim 1, further including a flat surface on the lens surface periphery of said acoustic lens body that is substantially rougher than said lens surface.

14. An acoustic probe according to claim 1, wherein said piezoelectric transducer means is a piezoelectric film formed on said lens surface on said one side of said lens body.

15. A method for producing an ultrasonic probe to be used to examine a sample, comprising:

providing an acoustic lens body of substrate material;

forming a concave lens surface on said acoustic lens body;

disposing a piezoelectric transducer on the other side of said acoustic lens body in a position for generating ultrasonic waves in response to applying voltage to said piezoelectric transducer for focusing said ultrasonic waves through said lens surface to detect the reflected waves of said ultrasonic waves from the sample by said piezoelectric transducer for obtaining information about the surface or interior of said sample; and said providing said lens surface of said acoustic lens body including etching said substrate material of said acoustic lens body.

16. An acoustic probe method according to claim 15, wherein said etching is carrying out by the use of a mask layer which has a non-circular opening.

17. The method according to claim 16, wherein said etching is isotropic etching to produce a spherical lens surface.

18. The method according to claim 16, wherein said etching is conducted at different etch rates dependent on the directions of crystal axes of said substrate material to provide an etch profile comprising a central portion which has a spherical surface, and a peripheral portion which has a non-spherical surface having the smaller curvature in at least partial region thereof in the depth wise direction than that of said central spherical surface.

19. The method according to claim 16, including forming a plurality of said lens surfaces arrayed on said acoustic lens body.

20. The method according to claim 19, wherein said steps of forming and etching produce lens surface profiles having axes of their shapes intersecting with each other.

21. The method according to claim 20, wherein said step of forming disposes the lens surfaces at a spacing from each other within the range of closely adjacent to unified with each other around an axis of said acoustic lens body.

22. The method according to claim 16, further including etching a concave border etch profile around the outer peripheral portion of said lens surface by etching through a mask layer after said first mentioned etching.

23. The method according to claim 16, wherein said step of providing said acoustic lens body provides said acoustic lens body of a silicon substrate material.

24. The method according to claim 16, including thereafter forming a thin film of a material different from said substrate material of said acoustic lens body on said lens surface of said acoustic lens body.

25. The method according to claim 16, wherein said step of providing said substrate material of said acoustic lens body provides the substrate material as a single-crystal silicon; and thereafter forming a thin film of silicon dioxide acoustic matching material on at least said lens surface of said acoustic lens body.

26. The method according to claim 25, wherein said step of providing the silicon substrate provides the substrate as a laminated plurality of silicon substrates.

27. The method according to claim 25, further including the step of forming an integrated electronic circuit using the silicon substrate material on said lens body.

28. The method according to claim 16, further including the step of roughening a flat surface around the lens surface periphery of said acoustic lens body to a substantially greater extent than the surface of said lens surface.

29. The method according to claim 16, wherein said step of etching includes a preliminary step of providing a mask layer on said acoustic lens body and forming a spot like opening in said mask layer, and said step of etching isotropically etches the substrate material through said spot-like opening in said mask layer to provide said etch profile.

30. The method according to claim 29, including forming said spot-like opening in said mask layer as an elongated opening and wherein said etching is conducted through said elongated opening.

31. The method according to claim 16, wherein said step of etching includes photolithographically forming a mask on said substrate and etching through said mask; thereafter joining a second substrate to said first mentioned substrate on the surface opposite from said lens surface to form a sufficiently thick laminated lens body.

32. The method according to claim 16, further including forming a mask layer on said acoustic lens body to cover said lens surface after said step of etching; thereafter forming a ring-like opening in said mask layer around and spaced from said lens surface; and thereafter etching through said ring-like opening to form an outwardly concave etch profile surrounding and joining said concave lens surface to provide a sharp profile edge at said joining.

33. An acoustic probe according to claim 8, wherein said lens surface is spherical and said border etch profile is circular.

34. An acoustic probe according to claim 8, wherein said lens surface is elongated in one direction and wherein said border etch profile is of oval shape complementary to said elongated lens surface.

35. An acoustic probe according to claim 8, wherein said lens surface is elongated in one direction parallel to the one side of said acoustic lens body; wherein there are four of said lens surfaces having their directions of elongation orthogonally arranged with respect to each other, and said border etch profile surrounds each of said lens surfaces to provide an overall cross outer peripheral shape.

36. An acoustic probe according to claim 1, wherein said etch profile is spherical with a radius within a range of several micrometers to 1 mm.

37. The method according to claim 16, wherein said etching is carried out with an etchant that has an etch rate independent of the orientation of crystals within said acoustic lens body and wherein said etchant and the substrate material of said acoustic lens body provide isotropic etching.

38. An acoustic probe according to claim 1, wherein said lens surface has less than one percent error in the radius of curvature.

39. An acoustic probe according to claim 11, wherein said silicon dioxide film has a thickness of $\frac{1}{4}$ wave length with respect to the waves produced by said piezoelectric transducer means and wherein said silicon dioxide film has a uniform thickness.

40. The method according to claim 16, wherein said etching is conducted as photolithographic etching on a wafer of silicon substrate to provide a plurality of lens surfaces; and thereafter cutting said wafer into separate pieces, with each piece containing a lens surface.

41. The method according to claim 16, wherein said etching uses an etchant that has an etch rate independent of the orientation of the crystals within the substrate material of the acoustic lens body.

42. An acoustic probe according to claim 35, wherein said piezoelectric transducer means is divided into four pieces respectively opposite each of said four lens surfaces.

43. An acoustic probe according to claim 1, wherein the upper peripheral shape of said lens surface is generally square with rounded corners and said lens surface changes in shape uniformly and gradually to a spherical shape at the bottom of said lens surface.

44. An acoustic probe according to claim 1, wherein the upper periphery of said lens surface is non-circular and said lens surface smoothly changes from its upper periphery to a spherical lowermost surface.

45. An acoustic probe according to claim 1, wherein an electronic integrated circuit is integrated in said substrate material immediately adjacent said acoustic lens body, and said electronic circuit includes a preamplifier electrically connected to directly receive the output signal of said piezoelectric transducer means corresponding to detected reflected waves.

* * * * *